US010227207B2

(12) United States Patent
Sorsa et al.

(10) Patent No.: US 10,227,207 B2
(45) Date of Patent: Mar. 12, 2019

(54) ROUTING OPTIMIZATION IN A MULTI-DECK ELEVATOR

(71) Applicant: KONE Corporation, Helsinki (FI)

(72) Inventors: Janne Sorsa, Helsinki (FI); Marja-Liisa Siikonen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 411 days.

(21) Appl. No.: 15/009,550

(22) Filed: Jan. 28, 2016

(65) Prior Publication Data

US 2016/0145073 A1 May 26, 2016

Related U.S. Application Data

(63) Continuation of application No. PCT/EP2013/068034, filed on Aug. 30, 2013.

(51) Int. Cl.
*B66B 1/28* (2006.01)
*B66B 1/24* (2006.01)

(52) U.S. Cl.
CPC ..... *B66B 1/2433* (2013.01); *B66B 1/2458* (2013.01); *B66B 2201/233* (2013.01); *B66B 2201/306* (2013.01)

(58) Field of Classification Search
CPC ..... B66B 1/2433; B66B 1/2458; B66B 2201/233; B66B 2201/306
USPC ..... 187/247, 380–389, 391, 393, 902
See application file for complete search history.

(56) References Cited

U.S. PATENT DOCUMENTS 5,086,883 A * 2/1992 Schroder ..... B66B 1/2458 187/258
6,237,721 B1 5/2001 Siikonen
6,293,368 B1 * 9/2001 Ylinen ..... B66B 1/20 187/382
6,360,849 B1 3/2002 Hikita
6,419,051 B2 * 7/2002 Mori ..... B66B 1/2458 187/247
6,505,712 B2 * 1/2003 Hattori ..... B66B 1/2458 187/382
6,508,333 B2 1/2003 Kostka et al.
6,644,442 B1 * 11/2003 Ylinen ..... B66B 1/20 187/382

(Continued)

*Primary Examiner* — Anthony Salata
(74) *Attorney, Agent, or Firm* — Birch, Stewart, Kolasch & Birch, LLP

(57) ABSTRACT

A method for a passenger-allocation in a multi-deck elevator group where the decks of the elevator cars are stacked above each other and being mounted in a car frame to be moved synchronously in an elevator shaft utilizes an improved allocation strategy. The method is performed by a control unit to dispatch the elevator cars for serving any passenger call which can be entered as a landing call or a car call, wherein a call creates plural allocation proposals calculated by an optimization algorithm carried out by the control unit for dispatching an elevator to a passenger call. The allocation proposals are then processed in a routing algorithm defining one serving deck to be taken for the allocation of a specific call, which routing algorithm is restarted for any further incoming call independent of whether a further incoming call is creating new elevator allocation proposal(s) or when a reallocation timeout has passed. A computer program carrying out the method is further disclosed.

17 Claims, 1 Drawing Sheet

(56) References Cited

U.S. PATENT DOCUMENTS

| | | | | |
|---|---|---|---|---|
| 6,913,117 | B2 * | 7/2005 | Tyni | B66B 1/20 187/382 |
| 6,945,365 | B2 * | 9/2005 | Matela | B66B 1/20 187/247 |
| 7,694,781 | B2 * | 4/2010 | Sorsa | B66B 1/2458 187/382 |
| 7,900,750 | B2 * | 3/2011 | Mattsson | B66B 1/2458 187/247 |
| 8,132,652 | B2 * | 3/2012 | Hakala | B66B 1/2458 187/249 |
| 8,387,756 | B2 * | 3/2013 | Laihanen | B66B 1/2458 187/387 |
| 8,978,833 | B2 * | 3/2015 | Suzuki | B66B 1/2458 187/382 |
| 2001/0032756 | A1 | 10/2001 | Mori et al. | |

* cited by examiner

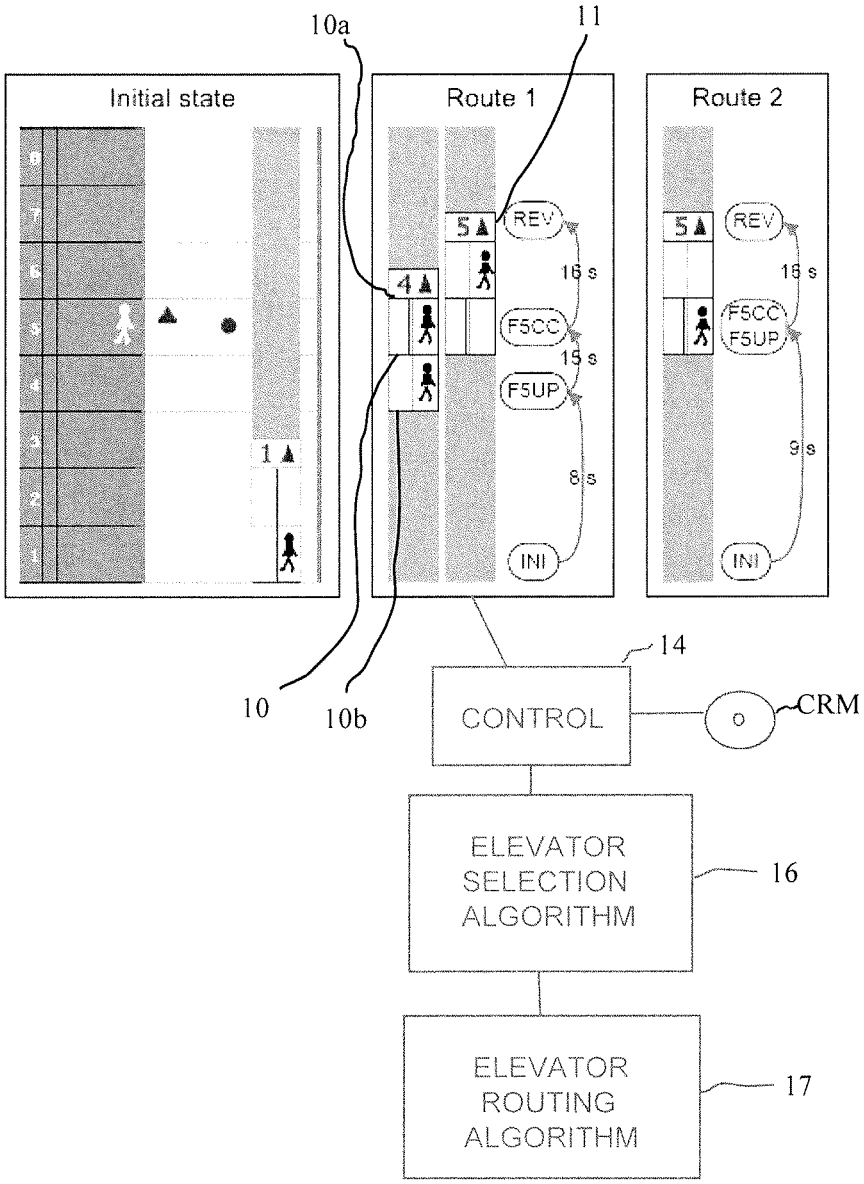
10a
11
Initial state
Route 1
Route 2
REV
F5CC
F5UP
INI
16 s
15 s
8 s
9 s
10
10b
14
CONTROL
CRM
ELEVATOR SELECTION ALGORITHM
16
ELEVATOR ROUTING ALGORITHM
17

ROUTING OPTIMIZATION IN A MULTI-DECK ELEVATOR

CROSS-REFERENCE TO RELATED APPLICATIONS

This application is a Continuation of PCT International Application No. PCT/EP2013/068034, filed on Aug. 30, 2013, the entire contents of the above-identified application is hereby expressly incorporated by reference into the present application.

The present invention relates to a method and thereto associated computer program for the allocation of passengers in a multi-deck-elevator group comprising multi-deck-elevators.

A multi-deck elevator consists of at least two elevator cars, i.e. decks that are fixed in the same frame. Thus, the frame including several cars moves as a single unit while being able to load and unload passengers simultaneously at several adjacent floors at one stop. This requires multi-loading lobbies on the ground floor which are interconnected for example by means of escalators. Because of this arrangement, a double-deck elevator for example stops only the over-next floor when it travels from the ground floor towards the upper floors. When serving passengers departing from upper floors however, both decks can stop at any floor and allow passengers to travel odd- to even-numbered floors and vice versa. In other words, when passengers' calls from the upper floors are served, both decks are allowed to serve any call. By the way, as for the reason for simplicity reference is taken in the following often to a double-deck-elevator, meaning a specific embodiment of multi-deck-elevator consisting of two elevator cars stacked one above the other and fixed in said car frame.

In prior art one knows a control for such kind of elevator for example from U.S. Pat. No. 6,237,721: the journey time including waiting time at the landing call floor and ride time inside a car to the destination floor is optimized by minimizing the passenger waiting time and ride time. The better deck to serve a landing call is selected by comparing the journey times internally for the elevator. The effects of a new landing call and new car calls are estimated separately for each deck. The passenger waiting and ride times are predicted and the landing call is allocated to the deck with the shortest journey time.

Mixed traffic is challenging for multi-deck elevators, especially during lunch hours in office buildings when passenger service times tend to be long, which consequently provides the motivation to develop multi-deck elevator group control further. The group control dispatches elevators to the passenger calls, being named passenger allocation: Each passenger enters his destination floor, wherein the starting floor being known due to the location of the call input device, so that it is possible to obtain unambiguous information regarding passengers trying to get onto the system. With these initial data, the elevator group control is able to find a preferable elevator car for each passenger. The group control dispatches elevators to serve the landing calls as given by the passengers in the lobby or on the landing floors while responding to the car calls for destination floors given by the passengers inside the elevator cars. Recent advances in computing technology have enabled a detailed planning of elevator routes as the basis of the dispatching decisions. The decision problem of the group control is formulated as an optimization problem called the elevator dispatching problem (EDP) which builds complete elevator routes through all existing landing and car calls. As long as there are landing calls waiting for service, the group control forms and solves new instances of the elevator dispatching problem to react to new calls and other changes in the states of elevators. An elevator routing algorithm defines then the order in which to serve the assigned landing calls, and alternative assignment proposals are ranked to minimize the total expected passenger waiting time.

As regards the double-deck or multi-deck elevators as referenced with the present invention, it is not only the elevator out of an elevator group which has to be selected for a specific passenger call but also the deck, i.e. the specific car of an elevator has to be selected by the elevator designation control.

Beside the eldest way to assign an elevator car to a passenger call according to which the control fixes the call to the serving elevator only once without further changes (=conventional control), in prior art there are two additional possibilities of call-assignment-policy, i.e. the continuous-call-assignment policy and the destination-control-assignment policy. According to the continuous-call-assignment policy as this is for example elucidated in documents U.S. Pat. No. 6,508,333 B2, U.S. Pat. No. 6,360,849 B1 or US 2001/0032756 A1, the group control of several elevators is allowed to optimize and change the serving elevator of a particular landing call until the last moment when the assigned elevator starts to decelerate to the landing floor. Once the elevator starts to decelerate, the call is cancelled and the serving elevator is fixed. By updating the assignment continuously, a weighting function can be taken into account (see for example US 2001/0032756 A1) that weights data elements according to priority for selecting the most appropriate deck of the car.

According to the destination-control-assignment policy, a passenger enters the destination floor already in the lobby or sometimes on landing floors from a destination operating panel. Said operating panel combines both the origin and the destination floor of the passenger and sends the information to the group control in a destination call. In this solution, the group control 14 immediately assigns an elevator to the destination call and sends the information back to the operating panel which then shows the assigned elevator to the passenger on its screen. It is also possible to combine the conventional up and down call buttons with destination operating panels of an elevator group. In these hybrid solutions, the destination operating panels are usually mounted in the entrance floor lobbies while the up and down call buttons are located on the upper floors. Thus, the assigned car of a destination call as entered in the elevator car is immediately fixed (since the car cannot be changed), while the allocation of a car for a landing call follows the continuous-call-assignment policy since it is convenient to let it still open which elevator car will serve a respective call.

It is object of the present invention to improve the passenger allocation in a multi-deck elevator to eliminate unnecessary stops as far as possible with respect to the existing calls on elevators' routes.

Said object is solved by the invention proposing a new method for a passenger-allocation in a multi-deck elevator group according to claim 1. A corresponding computer program may be stored on a computer readable medium CRM and is claimed according to claim 8.

The basic idea of the invention lies in that the way to find the best serving elevator car is divided into two hierarchical ordered sequences realized by two different algorithms, i.e. an optimisation algorithm and a routing algorithm. Both these algorithms follow different objectives, respectively. A feedback between these algorithms therefore means to focus on different objectives in different allocation phases carried out by a control unit of the elevator or elevator group. The special inventive concept of how this feedback is realized benefits from the inventors commission that it is invisible for the user which deck, i.e. car is serving him so that a final allocation of the deck can be postponed until a predetermined distance between the car and the call floor, meaning for example the last moment when the elevator starts to decelerate to the called floor. Said postponement leads to that unnecessary stops are diminished, thus decreasing also the round trip time of the elevator, leading in turn to maximize the handling capacity of the elevator which again results in that the passenger waiting- and transit times are diminished.

When the destination call is given by the user, the serving elevator and also the serving deck are allocated. The serving elevator results from the optimisation algorithm while the serving deck results from the routing algorithm. However, while the elevator allocation is not changed after the first allocation, the serving deck allocation will be reconsidered continuously either when a new destination call occurs or when a reallocation timeout of for example five hundred milliseconds (500 ms) has passed. Solely when the elevator has reached the predetermined distance or starts to decelerate, the currently allocated deck is then the one to serve the boarding floor, meaning that the allocation is then finally fixed.

As regards the optimization algorithm a big part of the possible solutions is trivially bad, which the optimization algorithm may have to process. This increases the time required to solve the optimization problem, what is not convenient for the real-time optimization, and thus decreases the quality of the solution explored. In other words: It is not the convenient way to reconsider both the elevator and the deck in case a new call is entered. This is because it creates too much solutions for serving a call, a big part of which is bad. That is why there are two objectives divided into two algorithms which replace the existing one and only optimization algorithm.

Applying the inventive concept to the designation-call-assignment policy, according to which the designation floor is already entered into the operating panel in the lobby, the passenger will be displayed only the serving elevator in the destination operating panel screen but not the deck—although the deck is assigned, too, but can be reassigned later on when a further incoming call is noticed or when the said reallocation timeout has passed. Taking advantage of the observation that a passenger does not recognize the deck which will serve him, the invention is introducing a new multi-deck-destination control that fixes the serving elevator immediately along with a serving deck, but which method reassigns the serving deck continuously until said defined distance from the call floor is reached by the car, which distance can be for example defined as the deceleration time point of the elevator. The inventive control system with a delayed deck assignment can therefore be called a semi-continuous multi-deck system. This also requires a new elevator routing algorithm that not only determines the serving order of the assigned calls but also selects the serving deck for each landing call. It turned out that the inventive semi-continuous destination control cannot be implemented into practise using the existing algorithm(s) since the computation times for solving an instance of all possible alternatives of an elevator routing are too long for a real-time group control. By means of the new method of linking two different algorithms serving different objectives however, the computation times are short such that the inventive delayed deck assignment, i.e. the semi-continuous control can be implemented in practise.

To this end, the new inventive method can be implemented either in an existing continuous-call-assignment policy as also into a destination-call-assignment policy: While a destination control increases the average passenger waiting time compared to a continuously fixing conventional control, it also brings several advantages: it increases the handling capacity of the elevator group, reduces the number of stops and reduces the average passenger transit time. The inventive semi-continuous destination control thus proved to be better than the traditional destination control by providing shorter passenger service times.

Another aspect is the optimization objective. As demonstrated by the simulation results in the example below, passenger waiting- and journey-times are conflicting objectives. There is a conflict between the global objective of waiting time and the local objective of maximizing coincident stops because in certain situations the optimum allocation is not necessarily wise—by human reasoning. Thus, it makes perfect sense to consider the problem as a multi-objective problem. The single-objective optimization probably produces such solutions to the multi-deck elevator dispatching problem that are in the extreme ends of the pareto-front. The natural question is whether there do exist solutions that other most of the advantages provided by destination control without sacrificing waiting time as much as the current single-objective optimization does.

According to a preferred embodiment the routing algorithm decides the serving deck according to at least one of the following rules: identifying coincident stops, selecting the deck with smaller load, arbitrary choice of either leading or trailing deck. Advantageously, these rules are hierarchical ordered in the sequence of first identifying coincident stops, second selecting the deck with smaller load, and third as arbitrary choice of either leading or trailing deck.

The inventive concept of deck-selection (DSP) is to minimize the number of stops and balance the load between the decks for one elevator trip at a time. To this end, the invention is to be understood in view of "trip" and "route", that a route of an elevator consists of one or more elevator trips, each of which contains several stops in the particular direction of travel. DSP models the selection of all the serving decks of one elevator trip at the same time.

Elevator route $R_e$ for each elevator is constructed as a sequence of elevator trips P in one direction of travel, each of which contains calls in the same direction, and ahead of the elevator with respect to its initial position in the beginning of the elevator trip. The direction corresponds to an elevator trip downwards and corresponds to upwards travel, respectively. Call direction is defined in the same way. The set $U_e$ denotes artificial calls that model the initial and end positions of an elevator in the trip. Artificial calls $U_e$ are also included in the set $V_e$. Elevator trip and route are defined below formally as:

Definition 1. Elevator trip P is an ordered set of calls (n1; . . . ; $n_{pmax}$) with $p_{max} \geq 2$ and $n_p \in V$ that satisfy $\delta_{n_p} = \Delta_p$ and $\delta_{n_{p+1}} \emptyset n_p$. The elevator trip starts and ends at artificial calls, $n_1$, $n_{pmax} \in U$.

Definition 2. Elevator route R is a sequence of elevator trips ($P_1$; . . . ; $P_{r\ max}$)

with $r_{max} \geq 1$ that satisfy $\Delta_{P_{r+1}} \rightarrow -\Delta_{P_r}$ for all r=1; . . . ; $r_{max}-1$.

The elevator routing algorithm processes the calls assigned to elevator e one-by-one and updates relevant state variables accordingly. In a similar step-wise manner, the serving deck $y_i$ is selected for each call by applying several rules, which, in priority order, try to detect coincident stops when both decks serve calls and to balance the load between the decks. In the case that these rules do not yet determine the serving deck, the leading deck of the elevator with respect to its direction of travel is chosen.

Since DSP concerns more about "where" the elevator stops than "when", it is possible to move from the call-based formulation of DD-EDP (=Double-Deck Elevator Dispatching Problem) and routing to the floor-based formulation. According to the following formula, the DSP is formulated below as an assignment problem that minimizes the number of stops of a double-deck elevator. To this end the main decision variable of DSP becomes $z_{dk}$, which equals 1 if deck d $\in \{1,2\}$ serves floor k $\in V_e^F \subset \{1, \ldots, N\}$, $V_e^F=\{Ø_i | i \in V_e\}$, and 0 otherwise. The sets $S_e^F$, $f(S_e^F)$, and $U_e^F$ are defined accordingly. In addition, the set $T_{ed}^F$ denotes the floors of the destination calls of the passengers inside deck d of elevator e, which have a fixed serving deck, $y_i$=d.

$$f1(z) = \min \sum_{k=k_{min}}^{k_{max}} \max_{d \in \{1,2\}} z_{d(k+d-1)} \tag{6}$$

$$\sum_{d=1}^{2} Z_{dk} = 1, \forall k \in S_e^F \tag{7}$$

$$z_{dj} = z_{dk}, j \in f(S_e^F), \forall k \in S_e^F \tag{8}$$

$$z_{dk} = 1, \forall k \in T_{ed}^F \tag{9}$$

$$z_{d(k_{min}+d-1)} = 1, \forall d \in \{1, 2\}, \text{if } \Delta_P = 1 \tag{10}$$

$$z_{d(k_{max}+d-2)} = 1, \forall d \in \{1, 2\}, \text{if } \Delta_P = -1 \tag{11}$$

$$z_{dk} \in \{0, 1\}, d \in \{1, 2\}, \forall k \in S_e^F \tag{12}$$

where $k_{min}$, and $k_{max}$ denote the lowest and the highest floor in the set $V^F_e$. The objective function (6) counts the number of stops to serve all call floors between $k_{min}$ and $k_{max}$. For each floor k $\in$ [$k_{min}$, $k_{max}$] in the sum, max $z_{d(k+d-1)}$ equals 1 if the lower deck is assigned to floor k and/or the upper deck is assigned to floor k+1. Therefore, the sum needs to consider all floors in the range, not only the call floors. Constraint (7) ensures that only one deck can be assigned to a floor, where passengers are waiting for a pick-up. This constraint arises from usability requirements of double-deck elevators. Constraint (8) connects the serving decks of the destination floors of the waiting passengers to the same decks that serve their origin floors. For passengers already inside deck d and travelling to floor k, constraint (9) forces a stop there for that deck. This constraint causes an additional restriction on floors k $\in S^F_e \cap T^F_{ed}$: if a passenger inside deck d is already heading towards floor k where other passengers are waiting for service, then deck d must also serve the waiting passengers. These constraints, however, allow both decks to serve the same destination floor k $\in T_{ed}^F$, $\forall$d $\in \{1, 2\}$. Constraint (10) or (11) is applied for an elevator trip upwards or downwards, respectively, if the elevator is standing on or decelerating to floor $k_{min}$ or $k_{max}$ when the elevator trip begins. To balance the passenger load between the decks, DSP needs to consider also passenger transfers on the call floors and loads of the decks after each stop. For this purpose, the net change in the number of passengers inside deck d on floor k is defined as $$p_{dk} = \sum_{i \in V_e^k} \omega_i z_{dk}, \forall d \in \{1, 2\}, \forall k \in V_e^F \tag{13}$$

where $V_e^k=\{i \in V_e | Ø_i=k\}$. The objective function to minimize the sum of squared differences between deck loads after each stop is defined as $$f_2(z) = \min \sum_{k=k_{min}}^{k_{max}-1} \sum_{j=k_{min}}^{k} |p_{1j} - p_{2j+1}| \tag{14}$$

where the inner sum represents the cumulative changes in the loads of both decks up to the (possible) stop on floor k and/or k+1. The above equation assumes that elevator direction of travel is upwards. For downwards travel, the floors need to be summed up in the decreasing order starting from the highest one.

The introduction of DSP into the routing algorithm changes its structure slightly since DSP considers all the calls of an elevator trip at once. In addition, the stop minimization and load balancing objective functions are applied sequentially keeping their priority order as in the original algorithm. Thus, in the first phase, DSP with objective function (6) is solved to find solutions with minimum number of stops. If, and only if, there are multiple equally good minimum stop solutions, then objective function (14) is evaluated for only those. This way, the first phase reduces the possibly large number of solution alternatives to only few good ones for the second phase. The two objective functions could also be used to solve DSP as a multi-objective optimization problem. The above formulation generalizes in a rather straightforward manner to multi-deck elevators which consist of more than two elevator cars. In the generalization, objective function (6) needs no changes, but objective function (14) needs to consider the load differences between all possible pairs of decks.

According to an embodiment of the invention, the passenger is allocated to the elevator car that is to serve him by a genetic allocation method by encoding the elevator routes into alternative chromosomes, the required data regarding the elevator cars and decks for the passenger being stored in a gene of the chromosome. In addition, utilizing genetic methods, alternative chromosomes are developed and the best one among these is selected, besides which the passengers indicated by the best chromosome are guided to the elevator car and deck represented by the best chromosome, while the elevator cars and decks indicated by the best chromosome are caused to serve the passengers stored on the chromosome. According to an embodiment of the present invention, the gene contains several allele alternatives as long as the genetic algorithm is running. According to another aspect, the genetic allocation can be performed in a GA kernel, from where an executive unit obtains the elevator car and elevator deck and selected for the passenger, who will be guided as a passenger.

In the following the invention is described by the aid of a double-deck-elevator example, which is displayed schematically in FIG. 1.

The concept of the double-deck elevator dispatching problem for conventional control is demonstrated by a numerical example to clarify the differences between the formulations of the deck-assignment problem of prior art and the inventive one of an elevator assignment problem. In FIG. 1, a simplified example is given, meaning a "group" of one double-deck elevator 10 having first and second decks 10*a*, 10*b* which will have to serve two passengers. Another double-deck elevator 11 is further illustrated.

FIG. 1 shows that initially, there is one passenger travelling in deck 1 (=lower deck) having registered a car call to floor 5 (circle) and one passenger waiting behind an up call at floor 5 (triangle upwards). The two possible routes to serve the passengers and the resulting stopping floors of deck 1 are shown titled with "Route 1" and "Route 2" depicting two possible ways to serve the up call. In the case of Route 1, the elevator first stops its upper deck to serve the up call at floor 5 (F5UP) and only after that the lower deck to serve the car call at floor 5 (F5CC). In the case of Route 2, only the lower deck is stopped at floor 5 to serve both the up and the car call at the same time. The arrows in the FIGURE depict movements of the elevator. Run times between the calls, including a 10-second stop time at floor 5, are shown beside the arrows. The table shows details of the calls including the artificial ones, elevator initial position (INI) and reversal floor (REV).

TABLE

| Call | Floor $\varphi_i$ | Direction $\delta_i$ | Passengers $\omega_i$ | Serving deck $y_i$ |
|---|---|---|---|---|
| INI | 1 | 1 | 1 | 1 |
| F5UP | 5 | 1 | 1 | 1 or 2 |
| F5CC | 5 | 1 | −1 | 1 |
| REV | 7 or 8 | 1 | −1 | 1 or 2 |

After the routes of the elevators have been created for the given assignment combination by the elevator selection algorithm 16, the quality of the assignment can be evaluated by an objective function such as passenger waiting- and journey-time. Since an elevator group is a service system, the global objective needs to be passenger-based (or call-based). However, it is possible to consider also other objectives, especially in the case of double-deck elevators, which evaluate the quality of the elevator routes locally. Such local objectives are, for example: 1) elevator travel time or distance, 2) number of stops, 3) number of coincident stops where more than one call is served, and 4) number of stops with only the other deck serving, i.e. there are passengers inside the deck but it does not serve any calls during a stop.

The table below shows the values of each of the above-mentioned objectives for Route 1 and 2 of the example.

| Objective | Route 1 | Route 2 |
|---|---|---|
| Passenger Waiting Time (s) | 8 | 9 |
| Passenger Journey Time (s) | 62 | 34 |
| Elevator Travel Time (s) | 39 | 25 |
| Number of Stops | 3 | 2 |
| Number of Coincident Stops | 0 | 1 |
| Stops with Other Deck Serving | 2 | 0 |

Consider first the global objectives, passenger waiting- and journey-time: Route 1 minimizes waiting time but Route 2 minimizes journey time with a marginal increase in waiting time. When looking at the local objectives, Route 2 is better than Route 1 in every measure. Which of the routes should be preferred? By experience, it is known that minimization of journey times results in significantly longer waiting times, which is not visible in this simple example. Naturally, prolonged waiting times are not desirable but Route 1 is clearly inefficient and therefore not desirable.

Consider again the example of FIG. 1 but now as the elevator-assignment-problem formulation. For the assignment, there is nothing to decide when the person in the lobby is the first entering a call, since there is only one convenient elevator-car in the group. Since the car call in the lobby already has a fixed serving deck, the car is selected and will not be changed later on.

If however the person in the fifth floor first enters his call, the elevator and the deck are assigned. The deck assignment can be deck 1 or deck 2. If it is the upper deck 2 being assigned, this deck will be re-assigned in case the person in the lobby enters his call for reaching the $5^{th}$ floor. If however it is deck 1 which had been allocated to the person in the $5^{th}$ floor, a reconsideration of the assigned deck will lead to no change and it is still deck 1 serving both.

In the following an algorithm is proposed as an example for the routing algorithm 17, i.e. for allocating and reconsidering the serving deck after having allocated the elevator:

```
Data: calls i ∈ V_e of elevator e
Result: elevator route R_e and serving deck y_e for i ∈ V_c
if W_k is not empty then
  | set W_k^main := arg min_{i∈W_k} {|φ_{n_k} − φ_i|};
  | set W_k^{main fixed} := {i ∈ W_k^min |y_i cannot be changed };
  | if W_k^{main fixed} is not empty then
  |   | set n_{k+1} := argmax_{i∈Wk}^{main fixed} {δ_c y_i};
  | else
  |   | set n_{k+1} := any i ∈ W_k^min;
  |   | if n_{k+1} is coincident with n_k then
  |   |   | set y_{n_{k+1}} := y_{n_k} + φ_{n_{k+1}} − φ_{n_k};
  |   | else if ∃_i ∈ V_c^{fixed} ahead of and coincident with n_{k+1} then
  |   |   | set y_{n_{k+1}} := y_i + φ_{n_{k+1}} − φ_i;
  |   | else if ∃_i ∈ V_c ahead of n_{k+1} and φ_{n_{k+1}} = φ_i then
  |   |   | set y_{n_{k+1}} := |min_{d∈{i,2}} δ_{n_{k+1}} d|;
  |   | else if ∃_i ∈ V_e ahead of and coincident with n_{k+i} then
  |   |   | set y_{n_{k+1}} := |φ_{n_{k+1}} − φ_i| |min_{d∈(1,2)} δ_{n_{k+1}} d|;
  |   | else if q_{e1n_k} ≠ q_{e2n_k} then
  |   |   | set y_{n_{k+1}} := argmin_{d∈(1,2)} q_{edn_k};
  |   | else
  |   |   | set y_{n_{k+1}} := |max_{d∈(1,2)} δ_{n_{k+1}} d|;
  |   | end
  | end
```

The invention claimed is:

1. A method for passenger-allocation in a multi-deck elevator group, the decks of each elevator defining elevator cars, respectively, and being stacked above each other and mounted in a car frame to move synchronously in an elevator shaft, the method being performed by a control unit to dispatch the elevator cars for serving a passenger call, the method comprising:

creating plural allocation proposals calculated by means of an optimization algorithm carried out by the control unit for dispatching an elevator to a passenger call, processing the allocation proposals in a routing algorithm defining a serving deck to be allocated to a specific passenger call; and rerunning the routing algorithm for any further incoming call or when a reallocation timeout has passed.

2. The method according to claim 1, wherein the routing algorithm is restarted for any further incoming call until a defined distance from the call floor is reached.

3. The method according to claim 2, wherein said defined distance is defined as the point when the elevator begins to decelerate for serving a call.

4. The method according to one of claims 1 to 3, wherein the routing algorithm decides the serving deck to be allocated to a call according to at least one of the following rules: minimizing a number of elevator stops, minimizing a load difference between the decks of the elevator, selecting the deck of the elevator with smaller load, arbitrarily choosing either leading or trailing deck of the elevator.

5. A method for passenger-allocation in a multi-deck elevator group, the decks of each elevator defining elevator cars, respectively, and being stacked above each other and mounted in a car frame to move synchronously in an elevator shaft, the method being performed by a control unit to dispatch the elevator cars for serving a passenger call, the method comprising:

creating plural allocation proposals calculated by means of an optimization algorithm carried out by the control unit for dispatching an elevator to a passenger call, processing the allocation proposals in a routing algorithm defining a serving deck to be allocated to a specific passenger call; and rerunning the routing algorithm for any further incoming call or when a reallocation timeout has passed;

wherein the routing algorithm decides the serving deck to be allocated to a call according to at least one of the following rules: minimizing a number of elevator stops, minimizing a load difference between the decks of the elevator, selecting the deck of the elevator with smaller load, arbitrarily choosing either leading or trailing deck of the elevator; and wherein the rules are hierarchically ordered in the sequence of first minimizing number of stops, then minimizing load difference between the decks.

6. The method according to claim 1, wherein the optimization algorithm is an integer optimization algorithm, especially a genetic algorithm.

7. The method according to claim 1, wherein the routing algorithm is an integer optimization algorithm, especially a genetic algorithm.

8. The method according to claim 1, wherein the method considers passenger transfers on the call floors and loads of the decks after each stop to minimize the number of stops and balance the load between the decks for one elevator trip at a time.

9. In a method for passenger-allocation in a multi-deck elevator group, the decks of each elevator defining elevator cars, respectively, and being stacked above each other and mounted in a car frame to move synchronously in an elevator shaft, the method being performed by a control unit to dispatch the elevator cars for serving a passenger call, a computer readable medium fixed in a tangible medium, the computer readable medium when executed on a computer performing:

creating plural allocation proposals calculated by means of an optimization algorithm carried out by the control unit for dispatching an elevator to a passenger call, processing the allocation proposals in a routing algorithm defining a serving deck to be allocated to a specific passenger call; and rerunning the routing algorithm for any further incoming call or when a reallocation timeout has passed.

10. The method according to claim 2, wherein the optimization algorithm is an integer optimization algorithm, especially a genetic algorithm.

11. The method according to claim 3, wherein the optimization algorithm is an integer optimization algorithm, especially a genetic algorithm.

12. The method according to claim 4, wherein the optimization algorithm is an integer optimization algorithm, especially a genetic algorithm.

13. The method according to claim 5, wherein the optimization algorithm is an integer optimization algorithm, especially a genetic algorithm.

14. The method according to claim 2, wherein the routing algorithm is an integer optimization algorithm, especially a genetic algorithm.

15. The method according to claim 3, wherein the routing algorithm is an integer optimization algorithm, especially a genetic algorithm.

16. The method of claim 1 wherein the step of creating allocation proposals occurs once at the time of each elevator call;

the processing of said allocation proposals being performed after said creating and being rerun in said rerunning step as a result of further incoming calls.

17. The computer readable medium of claim 9 wherein the step of creating allocation proposals occurs once at the time of each elevator call;

the processing of said allocation proposals being performed after said creating and being rerun in said rerunning step as a result of further incoming calls.

* * * * *